US010571222B2

(12) United States Patent
Strocchia-Rivera

(10) Patent No.: US 10,571,222 B2
(45) Date of Patent: Feb. 25, 2020

(54) PAYLOAD LAUNCHING APPARATUS AND METHOD

(71) Applicant: Stephen Tomás Strocchia-Rivera, Rhinebeck, NY (US)

(72) Inventor: Stephen Tomás Strocchia-Rivera, Rhinebeck, NY (US)

( * ) Notice: Subject to any disclaimer, the term of this patent is extended or adjusted under 35 U.S.C. 154(b) by 4 days.

(21) Appl. No.: 15/697,486

(22) Filed: Sep. 7, 2017

(65) Prior Publication Data

US 2019/0072362 A1 Mar. 7, 2019

(51) Int. Cl.
*F41F 3/07* (2006.01)
*F41B 15/00* (2006.01)

(52) U.S. Cl.
CPC ..... *F41F 3/07* (2013.01); *F41B 15/00* (2013.01)

(58) Field of Classification Search
CPC ..... F41F 3/07; F41B 15/00
USPC ..... 102/399; 89/1.809–1.81
See application file for complete search history.

(56) References Cited

U.S. PATENT DOCUMENTS 2,837,971 A 6/1958 Wosak
3,072,022 A * 1/1963 Wood ..... F41F 3/042 206/3
3,077,143 A 2/1963 Draim
3,093,033 A 6/1963 Draim
3,122,057 A * 2/1964 Kubit ..... B64G 5/00 244/1 R
3,135,162 A * 6/1964 Kamalian ..... F41F 3/07 89/1.81
3,137,203 A * 6/1964 Brown ..... F41F 3/07 102/411
3,153,979 A * 10/1964 Villers ..... F41F 3/07 42/76.01
3,158,062 A * 11/1964 Feiler ..... F41F 3/07 102/413
3,166,977 A * 1/1965 Pickett ..... F41F 3/07 441/1
3,166,979 A * 1/1965 Draim ..... F02K 9/95 102/380
3,180,225 A * 4/1965 Draim ..... F41F 3/07 102/399
3,181,422 A * 5/1965 Draim ..... F42B 15/20 114/125
3,208,346 A * 9/1965 Penza ..... F41F 3/07 441/1
3,217,599 A * 11/1965 Meeker ..... F41F 3/07 441/30
3,242,810 A * 3/1966 La Pointe ..... F41F 3/07 102/390

(Continued)

*Primary Examiner* — Michelle Clement
(74) *Attorney, Agent, or Firm* — Graham S. Jones, II

(57) ABSTRACT

A method and device are provided for launching a payload from water, including a launching tube having inside walls, outside walls, a top and an inlet at the tube bottom, with the tube anchored to the bottom water surface. The tube includes a nozzle or neck inlet to the bottom and an open top outlet. A gate valve at the inlet is opened by remote control signals; or an explosive plug at the inlet is removed by an explosion initiated by remote control. The launching tube loaded with a payload and air filled and empty of water is installed in water with the inlet and the tube bottom proximate to the bottom water surface deep below the tube top, which is positioned above the water surface.

18 Claims, 7 Drawing Sheets

(56) References Cited

U.S. PATENT DOCUMENTS 3,245,318 A * 4/1966 Finkelstein ..... F41F 3/07 89/1.809
3,249,014 A * 5/1966 Daughenbaugh ..... F41F 3/07 89/1.809
3,279,319 A * 10/1966 Semonian ..... F41A 1/10 89/1.701
3,295,411 A * 1/1967 Lehmann ..... F41F 3/07 89/1.81
3,301,132 A * 1/1967 Lehmann ..... F41F 3/07 89/1.81
3,327,586 A * 6/1967 Meade ..... F41F 3/07 89/1.81
3,340,767 A * 9/1967 Penza ..... F41F 3/07 89/1.809
3,499,364 A * 3/1970 Ooge ..... F41F 3/07 89/1.81
3,513,750 A * 5/1970 Penza ..... F41A 1/08 89/1.809
3,827,669 A 8/1974 Rodgers
4,586,421 A * 5/1986 Hickey ..... F41F 3/07 102/411
4,646,618 A * 3/1987 Kurth ..... B29C 67/0014 89/1.816
4,665,791 A * 5/1987 Bugiel ..... E21B 25/18 89/1.1
4,724,738 A * 2/1988 Johnson ..... F41F 3/07 244/171.3
5,044,253 A 9/1991 Moody
5,076,192 A * 12/1991 Tegel ..... F41F 3/042 114/316
5,092,222 A * 3/1992 Lynch ..... F41F 3/07 89/1.809
5,099,745 A * 3/1992 Hubbell ..... F41F 3/10 114/238
5,170,005 A * 12/1992 Mabry ..... F41F 3/07 89/1.11
5,284,106 A * 2/1994 Meng ..... B63H 11/025 114/238
5,438,948 A * 8/1995 Moody ..... B63G 8/32 114/238
5,542,333 A * 8/1996 Hagelberg ..... F41F 3/07 220/378
5,834,674 A * 11/1998 Rodriguez ..... F41F 3/10 89/1.81
6,044,745 A * 4/2000 Hickey ..... B63C 11/40 102/399
6,164,179 A * 12/2000 Buffman ..... F41F 3/07 114/316
6,220,196 B1 * 4/2001 Escarrat ..... B63G 8/32 114/238
6,286,410 B1 * 9/2001 Leibolt ..... F41F 3/07 89/1.809
6,371,003 B1 * 4/2002 Hickey ..... B63B 21/27 102/411
6,401,645 B1 * 6/2002 Ansay ..... B63G 5/00 114/238
6,415,211 B1 * 7/2002 Kotlow ..... F42B 35/00 102/399
6,487,952 B1 * 12/2002 Borgwarth ..... F41F 3/07 89/1.81
6,502,528 B1 * 1/2003 MacLeod ..... F41F 3/10 114/238
6,851,347 B1 * 2/2005 Plunkett ..... F41F 3/07 89/1.806
6,854,409 B1 * 2/2005 Galliano ..... B63G 8/32 114/238
6,871,610 B1 * 3/2005 Galliano ..... B63G 3/02 114/238
7,032,530 B1 * 4/2006 Ansay ..... B63G 8/28 114/312
7,165,917 B2 1/2007 Rode
7,243,609 B1 * 7/2007 Ansay ..... F41F 3/07 114/316
7,472,866 B2 * 1/2009 Heaston ..... B63G 8/28 244/63
7,681,352 B2 * 3/2010 Fu ..... F41F 3/10 42/1.14
7,779,772 B2 * 8/2010 Wallin ..... B63G 8/30 114/319
7,832,134 B2 * 11/2010 Fu ..... F41C 9/06 114/316
7,845,298 B2 * 12/2010 Rayner ..... B63G 8/30 114/238
7,874,091 B2 * 1/2011 Fu ..... F41A 21/32 114/316
7,997,224 B2 * 8/2011 Owen ..... F41F 3/10 114/238
8,091,461 B1 * 1/2012 Buescher ..... F41F 7/00 114/318
8,161,899 B1 * 4/2012 Smallin ..... F41F 3/10 102/406
8,205,828 B2 * 6/2012 Bossert ..... F41F 3/07 114/238
8,205,829 B2 * 6/2012 Bossert ..... F41F 3/07 114/238
8,596,181 B2 * 12/2013 Root, Jr. ..... B63B 22/06 102/406
8,662,441 B2 * 3/2014 Powell ..... B64C 39/024 244/62
9,453,705 B2 * 9/2016 Sylvia ..... B63G 8/001
10,421,558 B2 * 9/2019 Smoker ..... B63G 8/30
2002/0170419 A1 * 11/2002 Borgwarth ..... F41F 3/07 89/1.81
2008/0111021 A1 * 5/2008 Toth ..... B63G 8/28 244/63
2009/0107386 A1 * 4/2009 Sampson ..... B63B 22/003 114/261
2009/0308236 A1 * 12/2009 Matveev ..... F41F 3/07 89/1.809
2011/0073707 A1 * 3/2011 Bossert ..... F41F 3/07 244/63
2011/0253026 A1 * 10/2011 Bossert ..... F41F 3/07 114/321
2012/0068009 A1 * 3/2012 Bossert ..... F41F 3/07 244/63
2012/0068010 A1 * 3/2012 Bossert ..... F41F 3/07 244/63
2012/0204709 A1 8/2012 Riggs
2015/0175278 A1 * 6/2015 Hunter ..... F41F 3/04 244/158.5
2016/0054097 A1 * 2/2016 Sylvia ..... B63G 8/001 124/73
2016/0178317 A1 * 6/2016 Powell ..... F41F 3/07 89/1.81
2017/0146317 A1 * 5/2017 Smoker ..... F41F 3/042

* cited by examiner

PAYLOAD LAUNCHING APPARATUS AND METHOD

This invention relates to use of deep water pressure to propel a payload from deep water into the atmosphere.

A problem with the propulsion of payloads towards, into and beyond the atmosphere has been the adverse environmental effects of the oxidation of significant quantities of liquid and/or solid propellants which emit greenhouse and/or toxic gases into the atmosphere. Such propellants have included liquid and solid materials. For example liquid propellants have included liquid oxygen and liquid hydrogen. Solid propellants have included hydrazine (dinitrogen tetrahydride), monomethylhydrazine, nitrous oxides such as dinitrogen tetroxide, ammonium perchlorate, hydrogen peroxide which also emit greenhouse gases into the atmosphere. Additional such propellants have included petroleum products, other chemical rocket fuels, and other chemicals which also emit greenhouse gases.

BRIEF SUMMARY OF THE INVENTION

The apparatus and methods in accordance with this invention allow easy reuse of the launch system infrastructure; and the infrastructure required for launching a payload is less expensive. The infrastructure is also less complex than traditional launch methods.

The method and apparatus in accordance with this invention are cost effective, and have reduced and/or minimal impact on areas occupied by human beings and land based animals, when based in the ocean.

In accordance with one aspect of this invention, an empty cylinder submerged in water is employed to generate propulsion of a payload by harnessing the buoyancy force exerted by an empty chamber submerged in water or an alternative high density fluid.

The buoyancy force in a body of fluid, whether it is air, gas or water, is an upwardly directed force exerted by the liquid or gaseous fluid that opposes or exceeds the weight of an immersed object as a function of its displacement volume.

There are 14.7 pounds of air on every square inch at sea level, or 1 atmosphere (atm.). Descending from the surface to 33 feet doubles the pressure from 1 atm. to 2 atm. Descending another 33 feet to 66 feet, triples the pressure from 2 atm. to 3 atm., and so forth. As the depth of an immersed object in a fluid increases, the buoyancy force increases as a function of depth as a result of the weight of the liquid or gaseous fluid above the immersed object. The pressure at the bottom of a tube filled with fluid is greater than at the top of the column. Similarly, the pressure at the bottom of an object submerged in a fluid is greater than the downward pressure on the top surface of the object. This pressure difference results in a force which if sufficient can provide acceleration of the object upwardly. The mathematical explanations of the force of buoyancy, the force exerted on an infrastructure; and the forces needed for propulsion are well understood by those skilled in the respective arts. Moreover, the mathematics and physics for proposed propulsion are similar, albeit in reverse, for the thrust produced by rockets. See: Engineering Mechanics; Second Vector Edition; Statics and Dynamics (1976; Higdon, Archie & William B. Stiles, chapters 11-7; Prentice Hall Inc. Englewood Cliffs, N.J.; and Chapter 4-13 Hydrodynamics/buoyancy means are provided for anchoring and supporting the launching tube in the liquid. Preferably provide a power supply for the flow blocking device and to the actuation device. Preferably the flow blocking device comprises a gate valve and the gate valve is operated by a hydraulic system. Preferably, power is supplied to the flow blocking device by a cable; and remote control lines connect the actuation device to the flow blocking device.

In accordance with another aspect of this invention a device for launching a payload from a liquid comprises a launching tube having inside walls, outside walls, a top and a bottom; a neck comprising an inlet to the bottom and an outlet open at the top; a flow blocking device comprising a gate valve or a plug at the inlet opened by remote control; An actuation device for sending remote control signals for opening and/or closing of the flow blocking device; the launching tube being installed in the liquid with the bottom located deep in the liquid the below the top; and the actuation device being adapted for sending a remote control signal for opening the flow blocking device. Preferably, the device includes a support secured to inside walls of the launching tube for supporting a payload above the flow blocking device, and means for anchoring the launching tube in the liquid. Preferably, the device includes a power supply for the flow blocking device and to the actuation device. Preferably the flow blocking device comprises a gate valve or explosive seal/plug. Preferably, the gate valve is operated by a hydraulic system or electric system. Preferably, power is supplied to the flow blocking device by a cable; and remote control lines connect the actuation device to the flow blocking device.

BRIEF DESCRIPTION OF THE DRAWINGS

FIG. 2 shows the payload prepared to be launched from the launching system; and FIG. 3 is modified from FIG. 2 to show the payload of FIGS. 1 and 2 having risen higher as it approaches being launched from the launching system.

DETAILED DESCRIPTION OF THE PREFERRED EMBODIMENTS

As stated above, in the past there has been the problem that propulsion of payloads into the atmosphere has been implemented by use of fuels which emit greenhouse gases which pollute the atmosphere. In addition, occasionally, those fuels have exploded inadvertently, causing destruction and danger to the nearby areas. As a solution to that problem, this invention provides an alternative to the use of such fuels in the initial stage of launching a payload into the atmosphere.

Figure 1:
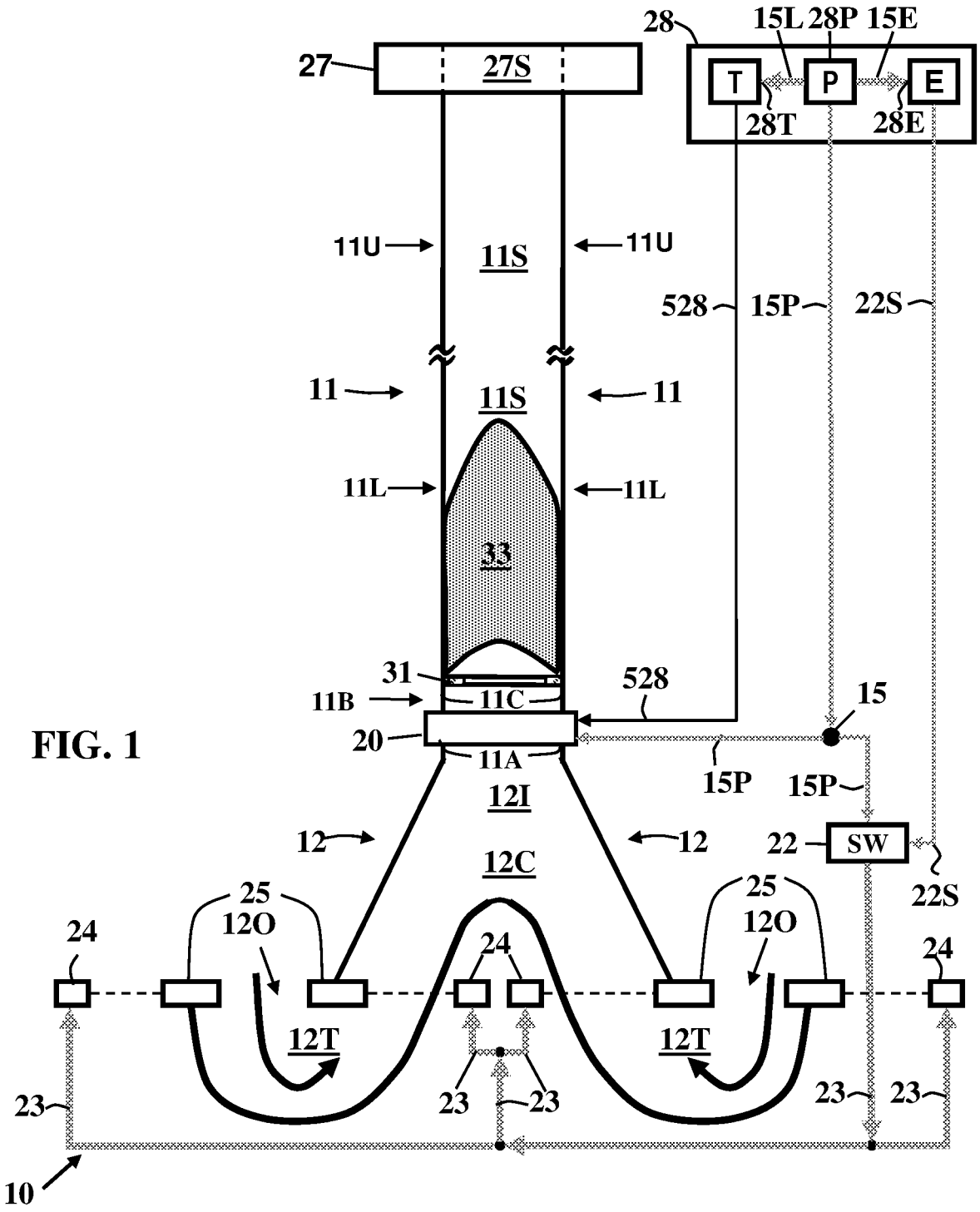
FIG. 1 is a schematic drawing showing a launching system in accordance with this invention comprising a propulsion device that is adapted to be at least partially immersed in a body of water.
Figure 2:
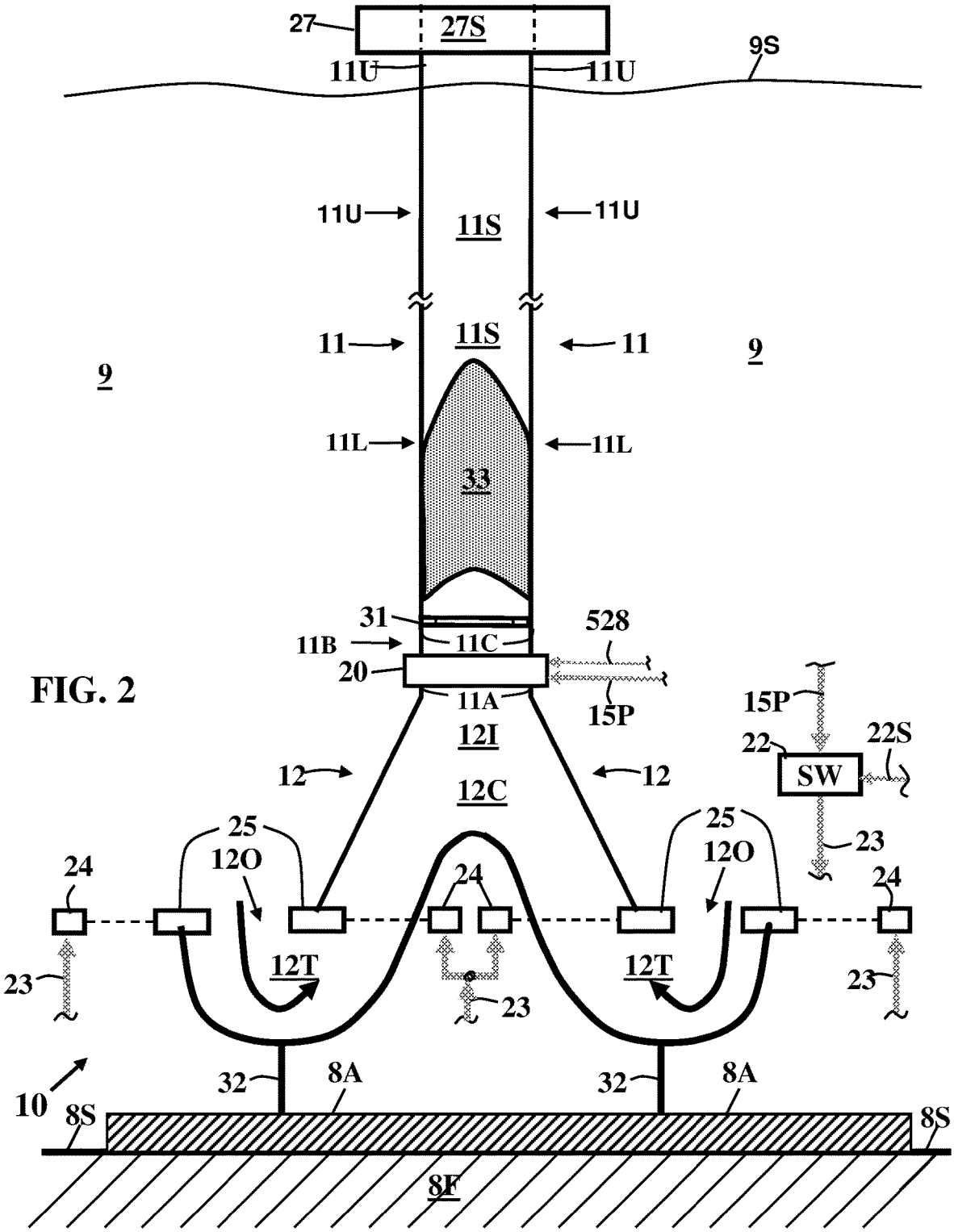
FIGS. 2 and 3 are schematic drawings showing portions of the launching system of FIG. 1 partially immersed in a body of water and with the launching system containing a payload to be launched from the launching system. In particular.
Figure 3:
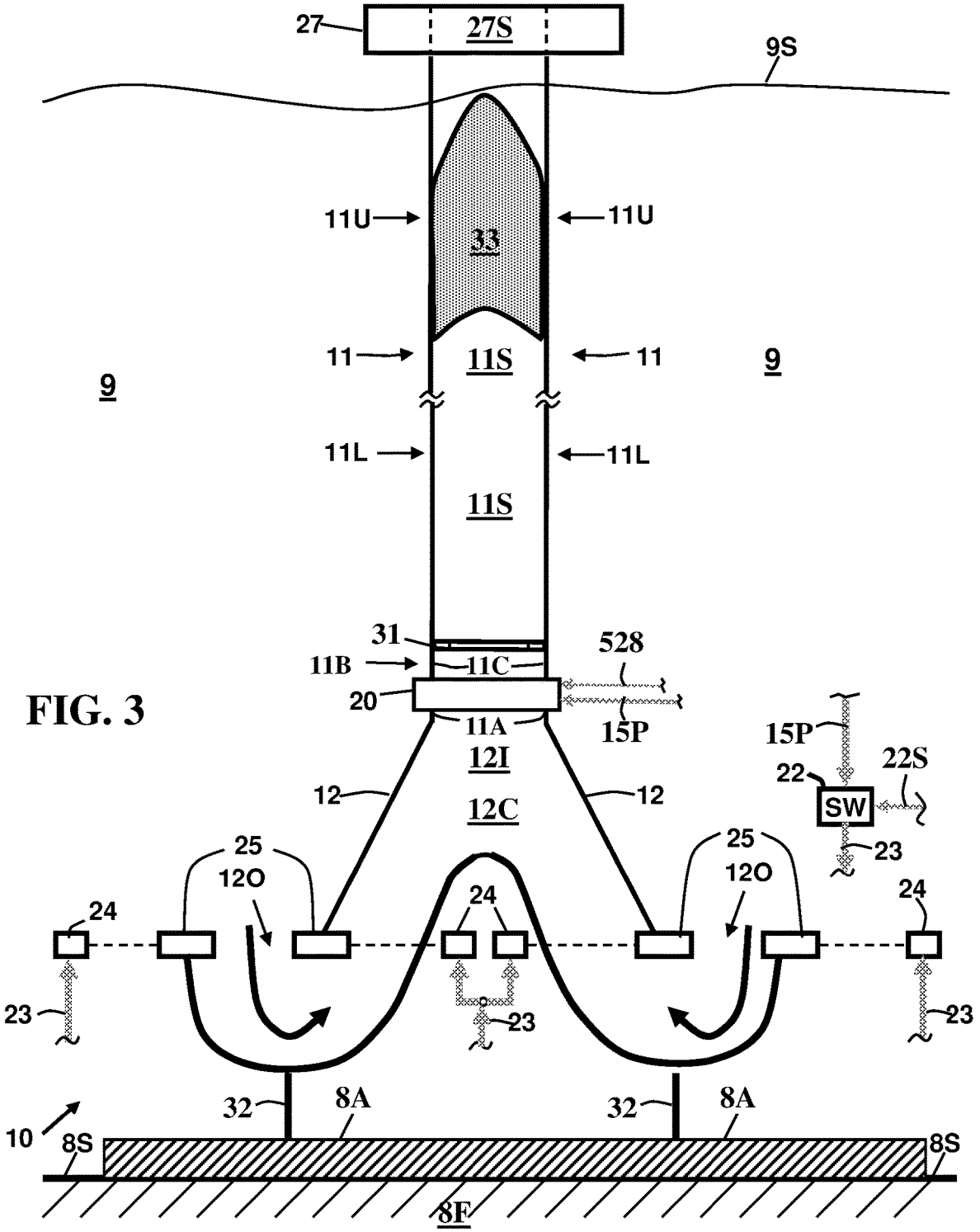

FIGS. 1, 2, and 3 show a launching system 10 in accordance with this invention for launching a payload 33 into space by propelling it up from the bottom of a launch tube 11 and launching it therefrom. The launching system 10 is adapted to be at least partially immersed in a body of water 9 (as shown in FIGS. 2 and 3). When the launch tube 11 is so immersed, the launching system 10 launches a payload 33 (FIGS. 2 and 3) from the launch tube 11 using the force of water pressure from water admitted to the bottom of the launch tube 11 from the body of water 9. A central station 28 shown in FIG. 1 includes a power source (P) 28P and an operator toggle device (T) 28T as an actuation device which provides remote control signals to a launch tube remote control valve system 20 at the bottom 11B of the launch tube 11. The remote control valve system 20 includes a hydraulic control system 578 which operates a gate valve 500 shown in FIGS. 5A, 5B and 5C to block water flow initially; but then, at launch under the control of the hydraulic control system 578 a gate valve 500 opens a gate 540 (FIGS. 5A-5C) thereby allowing rapid flow of water 9 into the launch tube 11 to propel the payload 33 upwardly and out into atmosphere/space from the top of the launch tube 11.

The central station 28 also includes an operator control switch (E) 28E for controlling access valve(s) 25 at openings 12O for supplying water under pressure through a convergent, tubular, nozzle 12 into to the bottom 11B of the launch tube 11 during the launching of the payload 33, as described in more detail below.

FIGS. 2 and 3 are schematic drawings which show modifications of the launching system 10 of FIG. 1 partially immersed in a body of water 9, with the launching system 10 containing the payload 33 shown in successive stages of being launched from the launch tube 11.

In the case of FIG. 2, the payload 33 is shown early in an initial stage of being launched from the launch tube 11 after the remote control valve system 20 has been opened to allow deep water pressure to apply thrust/pressure to payload.

FIG. 3 shows the payload 33 of FIG. 2 having risen higher as it is approaching being launched up out of the launch tube 11 after the remote control valve system 20 has been opened and remains open allowing continued thrust/pressure from deep water inrush.

The launching system 10 of FIG. 1 includes a hollow launch platform 27 affixed to the top of the upper segments of the launch tube 11 which is hollow, elongated, and which extends vertically. Segments of launch tube 11 are indicated by the segmented sidelines thereof including both upper 11U and lower 11S cylindrical, tubular segments. The hollow, launch platform 27, which is integral with the launch tube 11, includes a hollow, cylindrical, tubular, outlet channel 27S. Launch tube 11 includes a hollow, interior, tubular chamber 11S that is aligned with and combined with the hollow, cylindrical, tubular, outlet chamber 27S of the launch platform 27. The diameters of hollow, cylindrical, tubular spaces 11S and 27S are matched and aligned forming a combined vertical, hollow, cylindrical tubular chamber 11S/27S adapted for launching of the payload 33.

As shown in FIGS. 2 and 3 the launch tube 11, extends downwardly into the water 9 to a depth below the launch platform 27. The launch tube 11 defines a hollow right circular cylinder comprising the hollow, cylindrical, tubular chamber 11S which, as stated above, is aligned with the hollow, cylindrical, tubular, outlet chamber 27S in the platform 27 so that when the payload 33 is being launched, it can pass up therethrough with minimal impediment by passing up through the walls of the launch tube 11 and walls of outlet chamber 27S in the platform 27 with minimal friction. As shown in FIGS. 1-3, the launch tube 11 has an upper end 11U and a lower end 11L. The lower end 11L includes a bottom 11B. FIG. 3 shows the launching system 10 of FIGS. 1-3 with the payload 33 having risen to near the launch platform 27, as it is in the process of being launched from the launch tube 11.

As shown in FIG. 1, prior to launching, the payload 33 is supported just above the bottom 11B of the launch tube 11 by a support ring flange 31. The support ring flange 31 is secured to the inner walls of the launch tube 11 near the bottom 11B thereof, as shown in FIGS. 1-3, but located above the launch tube valve 500. Preferably, the support ring flange 31 is welded to the inner wall of the lower segment of the launch tube 11 to provide the support required for a heavy payload 33.

Figure 5A:
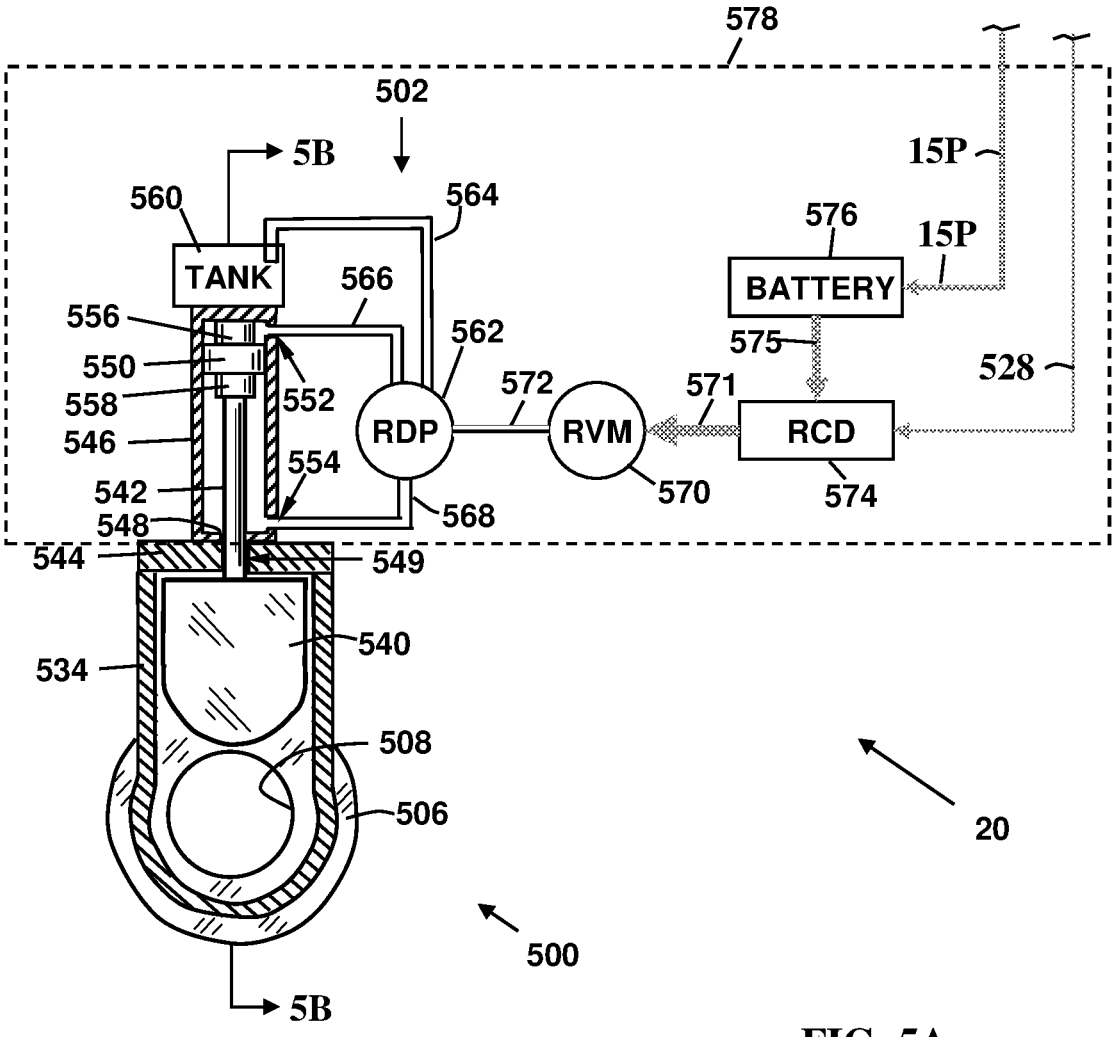
FIG. 5A is a sectional, elevational view of a remote control hydraulic valve system with the gate of the valve shown in the open position and the hydraulic control system depicted schematically.
Figure 5B:
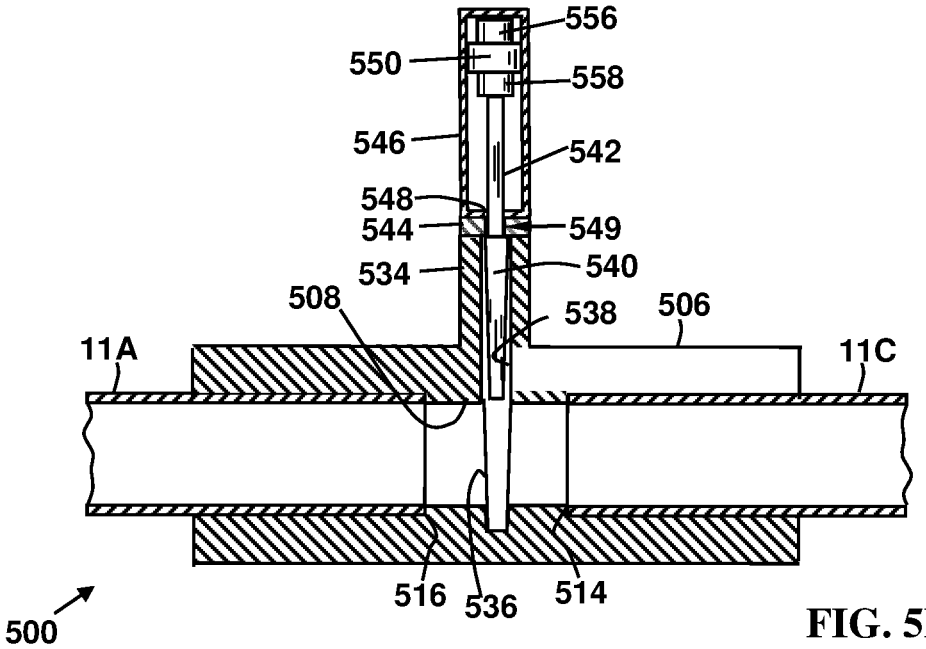
FIG. 5B is a view taken on line 5B-5B of FIG. 5A showing the gate of the valve shown in the open position.
Figure 5C:
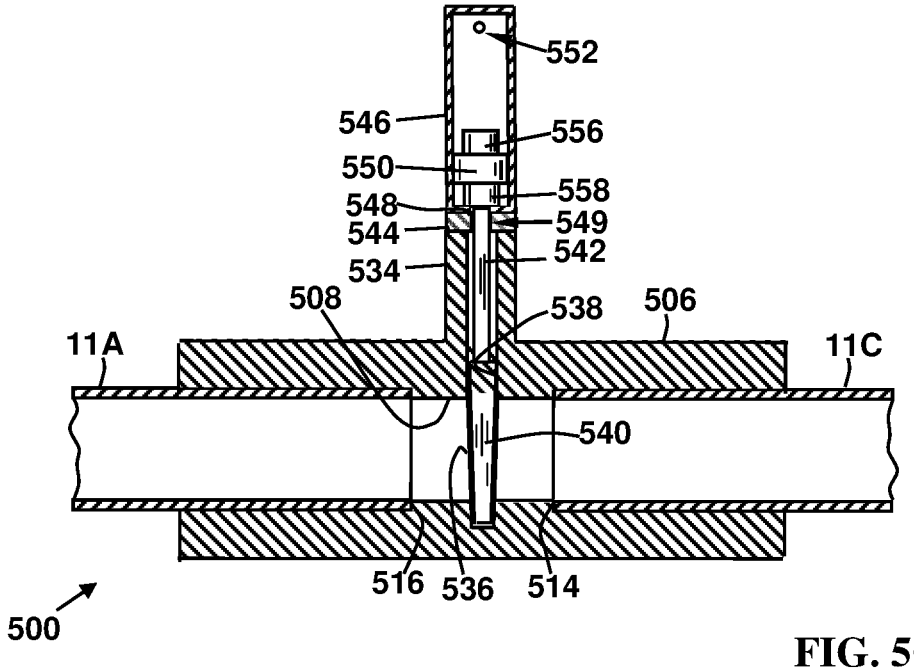
FIG. 5C is a view of a modification of FIG. 5B showing the gate of the valve in the closed position.
Figure 6:
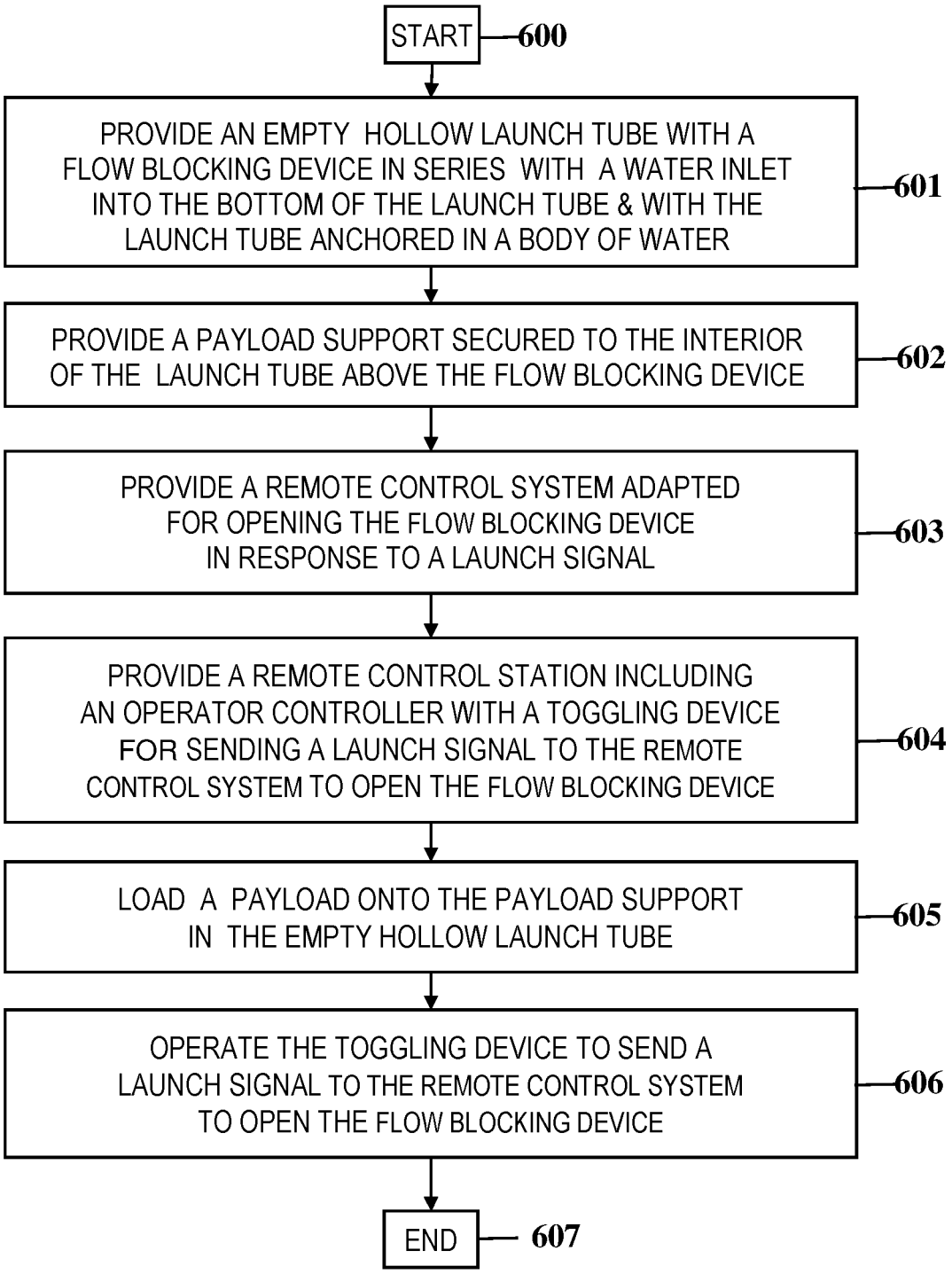
FIG. 6 is a flowchart of the methods in accordance with this invention of operating propulsion devices that are adapted to be at least partially immersed in a body of water.

The launch tube remote control valve system 20 at the bottom 11B of the launch tube 11 includes the gate valve 500 shown in FIGS. 5A, 5B and 5C. Joined to the bottom 11B of the launch tube 11 and integral therewith is a convergent, tubular, nozzle 12 for supplying water 9, under natural deep water pressure, to the launch tube 11 during the launching of the payload 33. The gate valve 500 is provided to close the bottom 11B of the lower segment 11L of the launch tube 11 prior to launch thereby holding back hydrostatic water pressure from allowing water to flow through the convergent, tubular, nozzle 12 into the bottom 11B of the launch tube 11. The gate valve 500 is shown in the pre-launch closed position in FIG. 5C as described below. During launching of the payload 33 illustrated by FIGS. 2 and 3, the gate valve 500 has been opened with the gate 540 retracted, as shown in FIGS. 5A and 5B.

In FIG. 2, after rising above the support ring flange 31, the payload 33 is shown as it is being propelled up through the hollow, tubular, launching chamber 11S of the launch tube 11 including the upper segment 11U thereof and farther up through the hollow, tubular outlet chamber 27S of the platform 27.

As shown in FIG. 3, the payload 33 is nearing launch above the platform 27 to reach an elevation, which may be far above the platform 27, depending upon the hydrodynamic forces exerted by the water 9 from below, which may become turbulent depending on the Reynolds number of the fluid flow, as will be well understood by those familiar with fluid dynamics. Prior to launch, the hollow tubular outlet chamber 27S and the aligned, congruent, hollow, tubular chamber 11S contain air instead of water to minimize resistance to acceleration of the payload 33. That facilitates launching of the payload 33. The convergent, tubular, nozzle 12 is formed with an opening(s) 12O connected to throats 12T which have U-turn shapes, and a convergent, tubular structure 12C to supply water at great depth under hydrodynamic pressure into the launch tube 11 when the gate valve 500 is open.

The throats 12T are provided for introducing the water under fluid pressure into the bottom 11B of the lower segment 11L of the launch tube 11 to propel the payload 33 from the launching system 10. The opening(s) 12O to the convergent, tubular, nozzle 12 are adapted to be controlled by one or a plurality of lower level, access valve(s) 25 which are shown in the normally-open position to admit water into the convergent, tubular, nozzle 12 prior to launch. Additionally, the convergent, tubular, nozzle 12 includes throats which can be constructed to provide anchoring, support, and stability to the launching system.

To review, FIGS. 1-3 show the of launch tube 11 with the launch tube remote control valve system 20 located at the bottom 11B of the hollow launch tube 11. Prior to launch time the launch tube, remote control valve system 20 includes the hydraulic control system 578 shown in FIG. 5A which is actuated by remote control signal from the operator toggle device 28T to actuate closing of the gate valve 500 shown in FIGS. 5A, 5B and 5C. In other words, prior to launch the gate valve 500 is in the normally-closed position to prevent water from entering the bottom 11B of the hollow launch tube 11. Referring to FIG. 1, at launch time the gate valve 500 in the launch tube, remote control valve system 20 is opened in response to a remote control signal on lines 528 from the operator toggle device 28T in FIG. 1 which actuates the hydraulic control system 578 shown in FIG. 5A which opens the valve 500.

During launch, the convergent, tubular, nozzle 12 which serves as a water jet is supplying water from a fluid collection system comprising the opening(s) 12O, the U-turn throat(s) 12T, and the convergent, tubular structure 12C. Fluid flowing through the opening(s) 12O is adapted to be controlled by optional, lower level, normally-open, access valve(s) 25. While valve(s) 25 are normally-open, they can be closed after launch when water is being evacuated from the launch tube 11.

Prior to launch, the access valve(s) 25 shown in FIGS. 1-3 are in the open position to permit water to enter the convergent, tubular, nozzle 12 through the opening(s) 12O and the U-turn throat(s) 12T. Opening(s) 12O, which may be one annular structure or separate structures, is/are formed as inlet(s) to the convergent, tubular, nozzle 12 to introduce water into the convergent, tubular, nozzle 12 flowing through the gate valve 500 in the launch tube, remote control valve system 20 at the bottom 11B of the hollow launch tube 11. The convergent, tubular, nozzle 12 is provided to accelerate the flow rate of water rushing therefrom into the launch tube 11. The opening(s) 12O to the convergent, tubular, nozzle 12 are controlled by one or a plurality of the optional, lower level, normally-open, access valve(s) 25 which are shown in the normally-open position to admit water into the convergent, tubular, nozzle 12 rapidly.

Referring again to FIG. 1, a central station 28 on or near the platform 27 contains a power supply 28P for supplying electrical power through cable 15P to node 15, through power supply cable 15L to operator toggle device 28T and through cable 15E to operator control switch (E) 28E. The operator toggle device 28T supplies valve control signals via control lines 528 to the launch tube remote control valve system 20. In addition, the power supply node 15 supplies power through cable 15P to the contacts of a normally-open, lower level control switch 22 which controls lower level access valve actuators 24 that are adapted, only when the contacts thereof are closed by operator activation of operator toggle device (E) 28E in central station 28, to supply power for closing the optional, normally-open, lower level access valves 25.

Referring to FIG. 5A, the control signals on control lines 528 connect to RCD 519 to open launch tube gate valve 500 when it is closed.

In addition, the power supply node 15 supplies power through cable 22S to the contacts of a normally-open, lower level control switch 22 which controls lower level access valve actuators 24 that are adapted (only when the contacts thereof are closed) to supply power for closing the optional, lower level, normally-open, access valves 25.

The power supply 28P also supplies power to the launch tube remote control valve system 20 and an operator control switch (E) 28E located in the controller 28.

To close the optional, normally-open, lower level the access valve(s) 25 the controller 28 also supplies switch signals from the operator nozzle evacuation control switch (E) 28E in the operator controller 28 which are sent on lower level cable 22S to close the normally-open lower level control switch (SW) 22. When normally-open SW switch 22 is closed, it sends power from node 15 through cable 15P via switch 22 and cables 23 to energize access valve actuator(s) 24 which close the lower level access valves 25, after launch completion while water 9 is being evacuated from the launching system 10, in preparation for the next launch.

As stated above, the payload 33 is to be propelled from above the support ring flange 31 up through the hollow, tubular chamber 11S of the launch tube 11 and up through the upper segment 11U thereof and farther up through the outlet chamber 27S of the platform 27 to be projected; far above the platform 27.

To facilitate launching the payload 33, the hollow, tubular outlet chamber 27S and the aligned, congruent, hollow, tubular chamber 11S/27S do not contain water initially, but instead are both filled with lower density atmospheric air instead of higher density water to minimize resistance to acceleration. Joined to the bottom 11B of the launch tube 11 and integral therewith is a convergent, tubular nozzle 12. The convergent, tubular, nozzle 12 is formed at the lower segment 11L of the launch tube 11 with U-turn throat(s) 12T and opening(s) 12O. Throat(s) 12T are provided for introducing water under deep water pressure (i.e. water at great depth) to into the lower segment 11L of the launch tube 11 to eject the payload 33 from the chamber 11S/27S of the launching system 10.

In FIG. 1, the bottom 11B of launch tube 11 is shown with the launch tube remote control valve system 20 with the gate valve 500 shown in FIG. 5B in the normally-closed position to prevent water from entering the bottom 11B of the launch tube 11 prior to the time for launch time for the payload 33. The normally-closed, launch tube, gate valve 500 is to be opened at launch time by a hydraulic control system 578 shown in FIG. 5A. The convergent, tubular, nozzle 12, which comprises a convergent, water pressure structure serving as a water jet, has opening(s) 12O with normally-open lower level, access valve(s) 25 shown in the normally-open position to permit water to enter the nozzle 12 through the opening(s) 12O and U-turn throats 12T which are connected to introduce water via a narrowing region 12C of the convergent tubular nozzle 12. The convergent tubular nozzle 12 introduces water via a narrowing region 12C and an inlet 12I below the normally-closed, launch tube gate valve 500. Opening(s) 12O which may be annular or separate structures formed on the convergent tubular, nozzle 12 serve to introduce water into the convergent tubular nozzle 12 flowing towards the launch tube 11. The convergent, tubular, nozzle 12 is provided to accelerate the flow rate of water rushing therefrom into the launch tube 11. The opening(s) 12O to the convergent, tubular, nozzle 12 are controlled by one or a plurality of lower level, access valve(s) 25 which are shown in the normally-open position to permit water to enter the nozzle 12.

In summary, until launching of the payload 33 is to be initiated, the hollow, launch tube, remote control, valve system 20 keeps the normally-closed, launch tube, gate valve 500 in the closed position to block water flow into the lower segment 11L of hollow launch tube 11.

The operator controller 28 supplies electrical power on cable 15P to power source node 15. The normally-closed, launch tube, gate valve 500 in the launch tube remote control valve system 20 can be opened by a signal on cable 528 from an operator toggle device (T) 28T operated by the user. Upon opening of normally-closed, launch tube, gate valve 500, the valve(s) 25 water from the converging region 12C of the convergent, tubular nozzle 12 passes through inlet 12I into the bottom 11B of the launch tube 11. That initiates launching of the payload 33. With the launch tube 11 installed in deep water, when the normally-closed, launch tube, gate valve 500 opens, it will admit water at very high pressure into the bottom end 11B of the launch tube 11 to launch the payload 33 from the launch tube 11 and from the platform 27.

The convergent, tubular, nozzle 12, which comprises a convergent, tubular structure serving as a water jet, which has opening(s) 12O with normally-open lower level, access valve(s) 25 shown in the open position to permit water to enter the nozzle 12 through U-turn throats 12T. Opening(s) 12O which may be annular or separate structures formed on the convergent, tubular, nozzle 12 serve to introduce water into the nozzle 12 flowing towards the launch tube 11. The convergent, tubular, nozzle 12 is provided to accelerate the flow rate of water rushing therefrom into the launch tube 11. The opening(s) 12O to the convergent, tubular, nozzle 12 are controlled by one or a plurality of access valve(s) 25 which are shown in the normally-open position to admit water into the nozzle 12.

As shown, the normally-open access valve(s) 25 can be closed by the access valve actuator(s) 24 which have been energized with power from power source node 15 delivered thereto through cable 21, switch 22 and cable 23. Switch 22 is adapted to be closed by a signal on cable 22S from nozzle evacuation switch 28E in the operator toggle device 28 to energize access valve actuator(s) 24 to close normally-open access valve(s) 25. The nozzle includes U-turn throats 12T which are connected to introduce water via a wide opening into a converging region 12C of the convergent nozzle 12 which narrows from the U-turn throats 12T to launch tube valve 500 of FIG. 5B in closed launch tube remote control valve system 20 is shown at the top of the convergent, tubular, nozzle 12. Prior to launch, the normally-closed, gate valve 500 is normally in the closed position to block water flow into the lower segment 11L of launch tube 11 until launching of the payload 33 is to be initiated.

FIG. 2 is a schematic drawing of the launching system 10 of FIG. 1 which contains the payload 33 rising off the support ring flange 31; and the launching system 10 is at least partially immersed in a body of water 9, which may comprise an ocean, a sea, a reservoir or a lake, etc. The body of water 9 has a top surface 9S far above the bottom surface 8S of the body of water 9, on top of the floor 8F, which is located deep at the bottom of the body of water 9. As described above, the launching system 10 of FIG. 2 includes the launch platform 27 on top combined to form the elongated, partially submerged launching system 10 as a propulsion device including an upright, vertically-extending, cylindrical, launch tube 11.

As shown in FIG. 2 most of the launching system 10 is located in the body of water 9. The hollow, vertical launch tube 11, which extends downwardly, has an upper segment 11U shown extending above the top surface 9S of the body of water 9. As stated above, both the platform 27 and the hollow, launch tube 11 comprise the aligned, hollow, tubular chamber 11S and the hollow, tubular, outlet 27S of the upper segment 11U which are filled with atmospheric air above the payload 33, prior to launch of the payload 33. From the top of launch platform 27 and the hollow, tubular outlet 27S located above the top surface 9S of the body of water 9, the launching system 10 extends vertically down towards the surface 8S of the floor 8F at the bottom of the body of water 9.

As shown in FIGS. 2 and 3, below the top launch platform 27, the downwardly extending vertical launch tube 11 has its upper segment 11U extending above the top surface 9S of the body of water 9 and its lower segment (11L) extending down near the surface 8S of the of the floor 8F of the deep body of water 9. That is to say that in FIGS. 2 and 3, below the top of its platform 27, almost all of the remainder of the complete launching system 10 is immersed in the body of water 9.

The composition of the water floor 8F, below the upper surface 8S thereof, comprises material such as soil, sand, and/or pavement, etc. In FIG. 2, the launching system 10 includes an elongated, submerged propulsion device including the upright, vertically extending, launch tube 11 and the top launch platform 27 filled with atmospheric air. The launch tube 11 is built in one or more sections of strong durable and waterproof material.

The launching system 10 shown in FIGS. 1-3 is adapted to launch the payload 33 from the lower segment 11L of the hollow launch tube 11 up through the tubular chamber 11S/27S and the outlet 27S through the platform 27 on the upper segment 11U of the hollow launch tube 11. The upright, vertically-extending hollow launch tube 11 extends vertically deep into the water 9 towards the surface of the deep floor 8F and is retained in the position shown in FIG. 2 as an upright, vertically-extending, cylindrical, launch tube 11 by means for anchoring, comprising anchor cables 32 shown that are secured from the bottom of the nozzle 12 at the bottom of the hollow, launch tube 11 to an anchor 8A. The anchor 8A is located below the nozzle 12, on the surface 8S on the water floor 8F. In FIG. 2, the launching system 10 includes an elongated, submerged propulsion device including the upright, vertically extending, launch tube 11. The downwardly extending vertical launch tube 11 has its upper segment 11U extending above the top surface 9S of the body of water 9 into the atmosphere and its lower segment (11L) extending down near the surface 8S of the of the floor 8F of the deep body of water 9. That is to say that in FIGS. 2 and 3, below the top of its platform 27, almost all of the remainder of the complete launching system 10 is immersed in the body of water 9. The water inlet 12 into the bottom of the launch tube 11 is anchored in a body of water 9 deep enough to provide a large buoyant force from the water. The vertical launch tube 11, which extends a downwardly, has an upper segment 11U shown extending above the top surface 9S of the body of water 9

The anchor 8A has sufficient weight to hold the launching tube 10 down against buoyancy forces and/or the anchor is secured to ledges deep in the floor 8F. When loaded with the payload 33, the launch tube 11 is adapted to propel the payload 33 contained therein preferably by positioning the upper segment 11U of the launch tube 11 above the top surface 9S of the water 9 to retain air in launch tube 11, thereby avoiding the drag on launching the payload 33 with the weight of water thereabove.

The payload 33 is to be located proximate to the lower segment 11L of the empty launch tube 11. The lower segment 11L of the launch tube 11 is shown closed by launch tube remote control valve 20 so that the payload 33 remains in position as the launch tube 11 is protected from the high pressure water therebelow. The payload 33 is to be propelled upwardly out of the upper segment 11U of tube 11 accelerated by tubular buoyancy forces exerted by pressure of the water 9 at the deep lower segment 11L of the launch tube 11, and the thrust/pressure of in rushing water.

The air filled launch tube 11 (when it is empty of water) is adapted to perform analogously to a gun barrel with the water pressure of the deep water being available to provide large buoyancy forces which can accelerate the payload 33 to a very high velocity. With proper balancing of characteristics of payload 33 including weight, aerodynamic structure, and buoyancy forces, and/or auxiliary booster rocket units (included in the payload) planetary escape velocities can be attained.

Referring again to FIG. 1, a convergent tubular nozzle 12 is formed at the bottom 11B of the launch tube 11. The convergent, tubular, nozzle 12 has inlets 12I with normally-open, access valve(s) 25 shown in the open position to permit water to enter the nozzle 12 through U-turn throats 12T. The access valve(s) 25 can be closed by the access valve actuators 24 which can be energized with power from power source node 15 through cable 21, normally-open switch 22 and cables 23.

The nozzle includes U-turn throats 12T which are connected to introduce water via a wide opening into a converging region 12C of the convergent nozzle 12 which narrows from the U-turn throats 12T to launch tube remote control valve system 20. The closed gate valve of launch tube remote control valve system 20 is shown at the top of the convergent, tubular, nozzle 12. The launch tube valve 500 remains in the closed position to block water flow into the bottom end 11B of launch tube 11 until launching of the payload 33 is to be initiated.

Figure 4A:
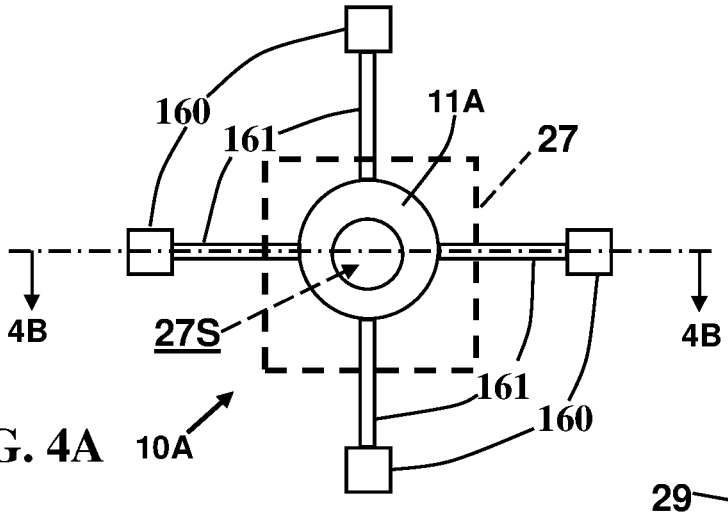
FIG. 4A is a schematic drawing of a plan view of an alternative embodiment in accordance with this invention comprising a propulsion device that is adapted to be at least partially immersed in a body of water.
Figure 4B:
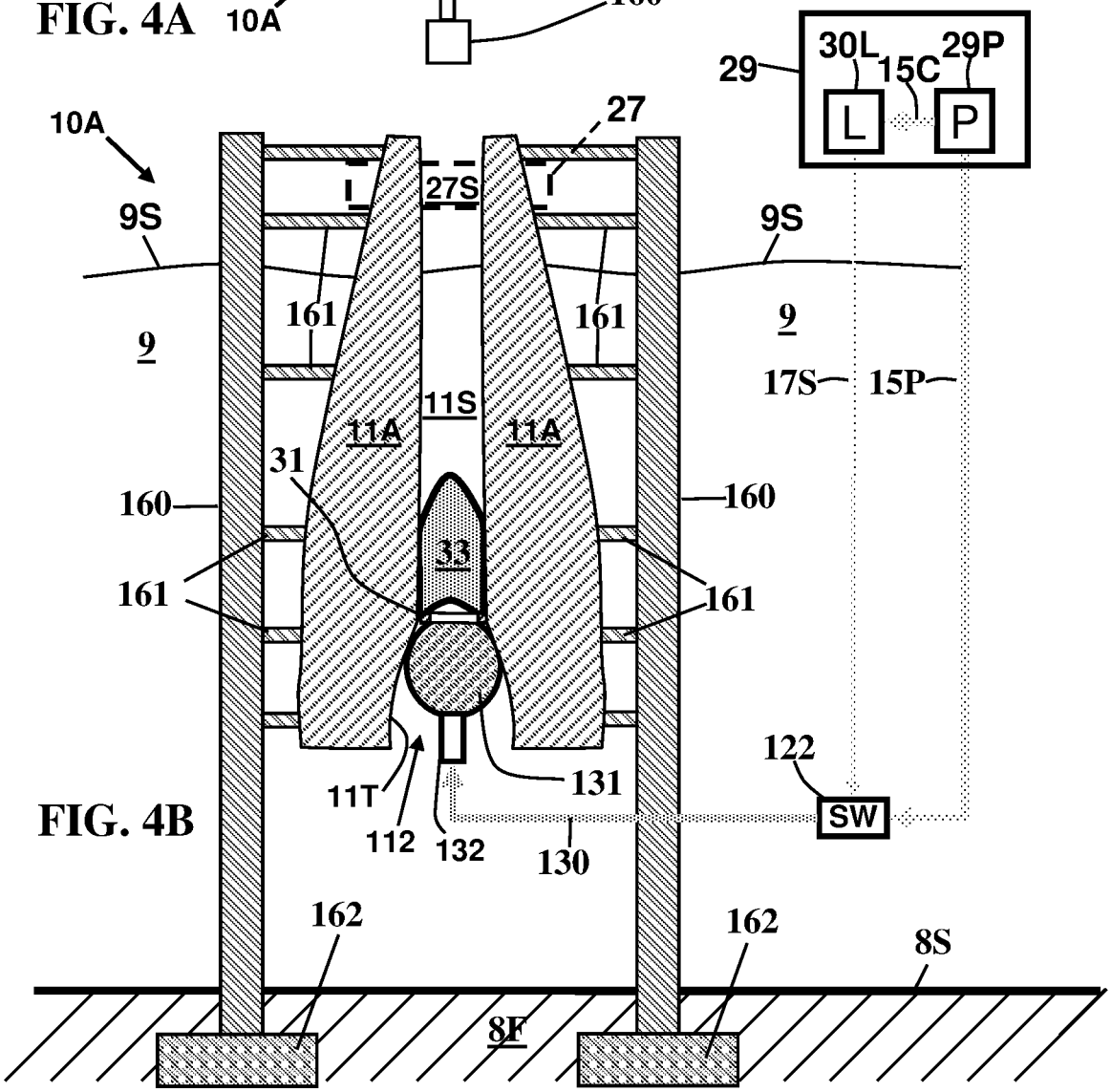
FIG. 4B is a sectional view of the launching system of FIG. 4A taken along section line 4B-4B of FIG. 4A.

FIG. 4A is a schematic drawing of a plan view of an alternative embodiment, in accordance with this invention, comprising a propulsion device 10A that is adapted to be at least partially immersed in a body of water. FIG. 4B is a section taken along line 4B-4B of FIG. 4A showing a modified, hollow launch tube 11A, which is rigidly supported partially below the surface of the water 9.

Referring to both FIGS. 4A and 4B, in order to provide rigid support for the modified, hollow, power generating tube 11A, a set of rigid, horizontal struts 161, a plurality of erect, vertical columns 160 and a plurality of heavy, deep water footings 162 are provided in the water floor SF. The erect, vertical columns 160 are rigidly supported by the deep water footings 162 buried in the surface 8S of the water floor SF. The rigid, horizontal struts 161, which extend between the modified, hollow, launch tube 11A and vertical columns 160, are affixed at inner ends to the modified, hollow, launch tube 11A and at distal ends to the vertical columns 160, as shown, which comprise means for anchoring that hold the modified, hollow, power generating tube 11A securely and rigidly in place. The vertical columns 160 are secured to an anchoring means comprising the deep water footings 162 in the water floor SF.

In FIG. 4B, the payload 33 is supported by a support ring flange 31 of the kind shown in FIGS. 1, 2 and 3. In addition, the hollow, launch tube 11A does not need to be formed in the circular configuration shown, but may have many alternative cross sections. The hollow, launch tube 11A is built with similar features to those of an artillery cannon in that the inner walls of the hollow, launch tube 11A can be smooth or rifled, as desired. The upper end of the chamber 11S/27S inside the hollow, launch tube 11A can be sealed by a structure 27 (shown in phantom) near the top thereof for the purpose of creating a vacuum therein. The launch tube 11A can be built with exhaust systems with plumbing and for pumping water or air out of the hollow, launch tube chamber 11S/27S. As will be well understood by those skilled in the art, such exhaust systems can be powered by a cable (not shown) from the electrical power supply (P) 29P shown in a modified, simpler control station 29.

Prior to launch, the neck 112 at the bottom of launch tube chamber 11S is sealed by an explosive plug 131 located beneath the support ring flange 31. The explosive plug 131 is provided as a wedge to seal the inlet 112 at the lower end of the launch tube chamber 11S in the launch tube 11A prior to ignition of the explosive plug 131. Inwardly tapered interior walls 11T of the neck 112 to the launch tube 11A extend from the bottom of the launch tube 11A up to above the top of the explosive plug 131. The walls 11T are tapered, inwardly from bottom to top along the narrowing walls 11T of the launch tube 11A for the purpose of concentrating in rushing water.

The wider surfaces of explosive plug 131 are jammed against the walls 11T to prevent the explosive plug 131 from sliding up prior to detonation of explosive plug 131. The explosive plug 131 has sufficient rigidity and strength to resist the significant pressures from the deep water 9. The explosive plug 131 is adapted to be ignited by the detonator 132 connected by the cable 130 to electrical power, as explained in detail below. Upon ignition of the explosive plug 131, the explosion of the explosive plug 131 and water pressure released from below launch the payload 33, although the explosive may be limited to only collapsing the plug thereby allowing deep water pressure to inrush into the launch system. The detonator 132 is similar to those of the type shown in U.S. Pat. No. 3,580,171. While the explosive plug 131 is shown with a spherical shape it may have several alternative shapes adapted to plug into the lower end of the interior, tubular chamber 11S of the launch tube 11A, so that [prior to ignition thereof, its exterior surface will form a water tight plug with the interior walls 11T of the tubular space of the launch tube 11A.

The detonation of the explosive plug 131 is controlled by firing control (L) switch 30L as an actuation device, which receives electrical power from electrical power supply (P) 29P by connections described below. Power is also supplied from power supply (P) 29P via cable 15P to a normally-open electrical switch 122. When activated by the operator, the firing control (L) switch 30L supplies a control signal on cable 17S which closes switch 122 thereby supplying electrical power via cable 130 to the detonator 132, causing detonator 132 to fire. Then, as a result of the firing of the detonator 132, the explosive plug 131 is detonated creating an explosion, which opens the neck 112 so that the explosion and water pressure entering the neck 112 create forces that launch the payload 33 from the top of the launch tube 11A.

An advantage of the present invention is that it provides a renewable, non-polluting source of energy. The propulsion of a payload 33 accelerated with power generated with buoyancy forces is inherently less polluting to the environment than either the known liquid propellants or the known solid propellants The chamber can have several variations in configuration depending on the requirements for structural stability. Preferably, the chamber has been described as being cylindrical but can have other shapes, but preferably the chamber is straight. The system is capable of submersion in a body of liquid and is strong enough to withstand forces of rapid buildup. Preferably, the launching system is sturdy, durable, and reusable. The inner surface of the chamber can be grooved or smooth. The chamber may be lined with an internal sleeve, which can be used to adjust the inner dimension of the chamber so that payloads of varying sizes can be launched. In addition, an optional: inner wall can be lined with a friction reducing material (e.g., (Teflon®), PolyTetraFluoroEthlyene (PTFE) PerfFluoroalkoxyAlkane (PFA) Fluorinated Ethylene Propylene (FEP), etc.

The chamber can be pre-manufactured with plumbing for post launch evacuation. The chamber can be manufactured or constructed with built-in wiring for power control of the post launch evacuation valves. A wide range of commercial valves are available, and the valves can be standard mechanical valves mechanically activated as an alternative to the above described embodiment of the present invention. Alternatively, explosive valves are preferred implementation for [producing very fast influx of water and/or pressure as shown in FIGS. 4A and 4B. Valves may also be activated by gasoline, propane gas an alternative to electrically controlled valves.

The payloads may need to incorporate cup, base, spindle or ring sabots as casements due to the large forces involved in launching. The sabots may have antifriction properties. Payload insertion can be performed by muzzle loading or breach loading, Cylindrical or alternative shape tube construction can be employed. Because of the strength requirements and straightness required much care is required in the construction of such tubes.

It is envisioned to be a single piece construction with provision for on shore construction and subsequent floating to a launch site. Sectional construction is possible.

FIG. 5A is a sectional elevational view of the hydraulic remote control valve system 20 of FIG. 1 with the gate 540 of a gate valve 500 shown in the open position and the hydraulic control system 578 depicted schematically.

FIG. 5B is a view taken on line 5B-5B of FIG. 5A showing the gate 540 of the gate valve 500 shown in the open position.

FIG. 5C is a view of a modification of FIG. 5B showing the gate 540 of the gate valve 500 shown in the closed position.

The hydraulic gate valve 500 which is operated by remote control is installed in the launch tube 11 as described above. Alternate remote open and close control signals selectively open the hydraulic gate valve 500 for fluid flow or close the gate valve 500 thereby blocking fluid flow through the launch tube 11. The hydraulic gate valve 500 in the tube 11 and has a gate 540 connected to a hydraulic piston 550 which can open and close the gate valve 500. The direction of flow of hydraulic fluid into the piston chamber 546 is controlled by a ReVersible (RVM) motor 570 which may be actuated from the operator toggle device 28T in the central station 28 whereby the hydraulic fluid may be directed to drive the valve stem 542 in one direction for closing of the gate valve 500, and in a reverse direction for opening of the gate valve 500.

The gate valve 500 is connected above the nozzle 12 in series in the launch tube 11 above the convergent, tubular, nozzle 12 for selectively controlling by allowing and/or preventing the flow of fluid therethrough. The gate 540 of the hydraulic gate valve 500 is fastened to the valve stem 542 which is connected with a piston 550 disposed for reciprocal movement within the piston chamber 546 for hydraulic fluid. Means is provided for directing hydraulic fluid into the piston chamber 546 for acting against one end of the piston in order to open the gate valve 500 to permit a free flow of fluid therethrough, and for alternately directing the hydraulic fluid to the opposite end of the piston 550 in order to close the gate valve 500, thereby blocking the flow of hydraulic fluid through the launch tube 11. The fluid control means comprises a suitable Reversible Drive Pump (RDP) 562 driven by the RVM 570 which is powered by a long life battery 576, with the actuation of the motor RVM 570 being under remote control from 28.

Referring to FIGS. 5A and 5B in detail, the remote control valve system 20 is provided for controlling by opening and/or closing of the hydraulic gate valve 500 by a hydraulic valve control system 578. The hydraulic gate valve 500, as shown herein comprises a main body 506 of substantially cylindrical configuration having a central bore 508 extending longitudinally therethrough to provide a fluid passageway and a gate 540 shown in FIGS. 5A and 5C retracted to an open position. The gate 540 is provided to close the gate valve 500 prior to launch of the payload 33 and to open at launch time in response to closing and opening signals respectively from the operator toggle device 28T in FIG. 1. Whereas the gate valve 500 may be interposed in a hollow, launch tube 11 in any suitable manner, as particularly shown herein, the ends 11A and 11C of adjacent launch tube 11C are shown inserted within and fastened to opposite ends of the central bore 508 of the main body 506 of gate valve 500 for interposing the hydraulic gate valve 500 in the hollow, launch tube 11.

Oppositely disposed longitudinally spaced annular shoulder 514 and annular shoulder 516 are provided in the central bore 508 for receiving the launch tube section 11A and launch tube section 11C, respectively, shown pressed thereagainst for limiting the longitudinal insertion of the launch tube sections within the main body 506 of the gate valve 500.

FIGS. 5A, 5B and 5C show the main body 506 of the hydraulic gate valve 500 with a sleeve 534 that is integral with extending at right angles from the main body 506. FIGS. 5C and 5B show both a recess 536 which is of tapered, annular configuration provided in the main body 506 which is in open communication at 538 in FIGS. 5B and 5C with the interior of the sleeve 534. The recess 536 is preferably of a tapered, wedge shaped cross-sectional configuration in a plane taken along the longitudinal axis of the main body 506, as best shown in FIG. 5C, for a purpose set forth below. A gate 540 (which is also tapered with a substantially wedge shaped cross-sectional configuration complementary to the tapered, configuration of the recess 536) is reciprocally disposed within the sleeve 534 so that it may be alternately lowered and raised within the sleeve 534 and across the central bore 508 of the main body 506, as viewed in the drawings.

As shown in FIG. 5B, in the lowered position of the gate 540, the gate 540 is disposed across the opening of the central bore 508 of the hydraulic gate valve 500 to preclude passage of fluid through the hydraulic gate valve 500. As shown in FIG. 5C, in the raised position of the gate 540, the gate 540 is lifted up to remove it from the central bore 508 to permit the free passage of fluid therethrough. The gate 540 is attached to a reciprocal valve stem 542 which extends axially outwardly from the sleeve 534 through an aperture 549 in cover 544 which is secured to the outer end of the sleeve 534.

In addition, suitable sealing means (not shown) is preferably interposed between the cover 544 and the sleeve 534 for precluding leakage of fluid therebetween, and further sealing means may preferably be interposed between the cover 544 and the reciprocal valve stem 542 for precluding leakage of fluid therebetween as will be well understood by those skilled in the art.

A fluid piston chamber 546 for hydraulic fluid is disposed above the cover 544 and is secured thereto. The housing 546 is provided with an aperture 548 in the surface thereof aligned with the aperture 549 and juxtaposed above the cover 544 for receiving the reciprocal valve stem 542 therethrough. Conventional sealing means (not shown) is preferably provided between the piston chamber 546 and reciprocal valve stem 542 for precluding leakage of hydraulic fluid therefrom.

A suitable piston 550 is provided on the reciprocal valve stem 542 and reciprocally disposed within the housing 546. A first port 552 is provided in the proximity of a first, upper end of the piston chamber 546, and a second port 554 is provided in the proximity of the lower, opposite end of the piston chamber 546.

The piston 550 is reciprocated between opposite ends of the piston chamber 546 by hydraulic fluid pressure within the piston chamber 546. Suitable stop means 556 is provided on the first, upper end of the piston 550 for limiting the movement thereof in the opened direction, and second stop means 558 is provided on the opposite, lower end of the piston 550 for limiting the movement thereof in the opposite, closed direction.

Referring to FIG. 5A, a hydraulic fluid reservoir 560 is connected via hydraulic fluid supply conduit 564 to supply fluid to a Reversible Drive Pump (RDP) 562. The reversible drive pump 562 is connected at opposing ports thereof to drive the piston 550 in the piston chamber 546 via valve closing port 552 and valve opening port 554 through suitable hydraulic fluid supply valve closing conduit 566 and valve opening conduit 568 respectively.

The reversible drive pump 562 is connected to be driven by a suitable ReVersible Motor (RVM) 570 by drive shaft 572. The RVM 570 is, in turn, operably connected to control the reversible drive pump 562 and to operate the hydraulic gate valve 500 by driving the piston 550 up or down to open and to close the gate 540 of the hydraulic gate valve 500 by a Remote Control Device (RCD) 574. The RCD 574 receives control signals from operator toggle device 28T in FIG. 1 via control lines 528.

In addition, referring again to FIG. 5A the control signals pass through control lines 528 to the distal end of control lines 528 which are directly connected to the control input of RCD 574.

Alternatively, control of the RCD 574 may be provided by a radio frequency control system (not shown) as will be well understood by those skilled in the art.

In addition, the hydraulic valve control system 578 is operably connected with a suitable power source, such as a long life battery 576 which is connected to an external power supply by cable 15P from node 15B.

The hydraulic fluid reservoir 560, reversible drive pump 562, RVM 570, the RCD 574 and battery 576 and the piston chamber 546 for the piston 550 which opens and closes the gate 540 of the hydraulic gate valve 500 are all installed within hydraulic valve control system 578 of the remote control valve system 20.

The hydraulic gate valve 500 and its ancillary hydraulic control system 502 are installed in the launch tube 11 in order to provide selective flow control of fluid passing through the launch tube 11. The hydraulic gate valve 500 is preferably installed between adjacent launch tube sections as hereinbefore set forth, and it is preferable to install the hydraulic gate valve 500 in such a manner that the gate 540 is in a normally open position as shown in FIGS. 5A and 5B.

It will be apparent that suitable sealing means (not shown) may be provided between the gate 540 and the recess 536 in order to preclude leakage of fluid therebetween, or the gate member may provide a metal to metal seal with the body 506, as is well known. In order to raise the gate 540 to the open position, the reversible drive pump 562 is activated in any well known manner for directing hydraulic fluid from the reservoir 560 into the piston chamber 546 through the port 554 below the piston 550. The hydraulic fluid pressure acting on the lower surface of the piston 550 urges the piston 550 upwardly, thus forcing any hydraulic fluid in the piston chamber 546 thereabove to be discharged through the port 552 and directed back into the hydraulic fluid tank 560.

The hydraulic fluid may be retained in the piston chamber 548 below the piston 550 in the usual manner for maintaining the piston 550 in the position shown in FIG. 5B. The hydraulic gate valve 500 may remain in this position, or until such time as it is required to close the hydraulic gate valve 500 for shutting down fluid flow between the convergent, tubular, nozzle 12 and the launch tube 11.

When it is desired to close the gate 540 of the hydraulic gate valve 500, a control signal is sent to the hydraulic control system 502 of FIG. 5 in the remote control valve system 20 from the operator toggle device 28T on control line 528 shown in FIGS. 1 and 5. The RCD 574 may thus be activated properly for operation of the RVM 570, which in turn actuates the reversible drive pump 562 for properly controlling the flow of the hydraulic fluid to and from the piston chamber 546. In order to close the hydraulic gate valve 500, the reversible drive pump 562 is actuated for directing the hydraulic fluid into the piston chamber 546 through the port 552 above the piston 550, while simultaneously withdrawing the hydraulic fluid from the port 554 below the piston 550. Of course, the hydraulic fluid pressure acting on the upper end of the piston 550 urges the piston 550 downwardly in the piston chamber 546 for moving the gate 540 downwardly to the position shown in FIG. 5B, thus closing the tube 11 and precluding the flow of hydraulic fluid through the hydraulic gate valve 500. The hydraulic fluid withdrawn from the lower portion of the piston chamber 546 may be either transferred to the upper portion thereof, or may be returned to the hydraulic fluid reservoir 60, as desired. Of course, the pressure may be maintained on the upper end of the piston 550 indefinitely, thus retaining the gate 540 in the closed position.

When it is desired to reopen the remote control valve system 20, the control device 574 may again be activated by a suitable signal from the operator toggle device 28T in FIG. 1 whereby the operation of the motor and the reversible drive pump 562 are reversed for reversing the flow of the hydraulic fluid to and from the piston chamber 546 in order to raise the piston 550, thus raising the gate 40 540 to the open position thereof.

Of course, it will be apparent that a suitable control panel (not shown) may be provided at the main control area having lights or other indicating devices whereby a visual inspection of the panel will disclose any malfunction at any of the remote control valve system 20 sites. When such a malfunction occurs, a suitable maintenance crew may be sent to the particular location for correcting the malfunction. Otherwise, the may be controlled for opening and closing of the tube 11 from the main control area with very little actual manual attendance at the site of the valves.

Method of Launch of Payload from Launch Tubes

In step 600, start the launching process for the devices 10/10A.

In step 601 provide an empty hollow launch tube 11/11A with a flow blocking device (gate valve 500/explosive plug 1311 in series with a water inlet (nozzle 12/neck 112) into the bottom of the hollow, launch tube 11/11A, with the hollow, launch tube 11/11A anchored in a body of water 9 deep enough to provide a sufficiently large buoyant force.

In step 602 provide a payload support 31 secured to the interior of the hollow, launch tube 11/11A above the flow blocking device 500/131.

In step 603 provide a remotely controlled device 20/132 adapted for opening the flow blocking device 500/131 in response to a launch signal.

In step 604 provide a remote control station 28/29 including an operator controller toggle device 28T/switch 30L for sending a launch signal to the remotely controlled device 20/132 to open the flow blocking device 500/131.

In step 605 load a payload 33 onto the payload support 31 in the empty hollow launch tube 11/11A.

In step 606 operate the operator toggle device 28T/switch 30L to send a launch signal to the remotely controlled device 20/132 thereby opening the flow blocking device 500/131 and launching the payload 33 from the launch tube 11/11A.

In step 607 the steps of the method end.

Whereas the present invention has been described in particular relation to the drawings attached hereto, it should be understood that other and further modifications, apart from those shown or suggested herein, may be within the spirit and scope of this invention.

What is claimed is:

1. A method for launching a payload from a body of water into the atmosphere, which body of water has a top surface and a bottom surface deep in said body of water, by the steps comprising:

providing an air filled, hollow, upright, vertically-extending launching tube for launching said payload from said body of water into the atmosphere with said hollow launching tube having an inside wall, an outside wall, a tube top and a tube bottom, with the launching tube top extending above said top surface of said body of water into the atmosphere and said hollow, air filled launching tube containing said payload;

providing a water inlet at the bottom of said launch tube at said tube bottom and an outlet open at said tube top;

providing a remote control, flow blocking device at said water inlet;

providing an actuation device for sending remote control signals to control said flow blocking device;

installing said hollow launching tube in said body of water with said tube top extending above said top surface of said body of water into the atmosphere;

anchoring said hollow launching tube with said water inlet to said tube bottom of said hollow launching tube held proximate to said bottom surface deep in said body of water;

positioning said tube top above said top surface of said body of water; and operating said actuation device for sending a remote control signal to open said flow blocking device to launch said payload, whereby said payload is adapted to be launched into the atmosphere from said hollow, air filled, launching tube projected by water pressure force from deep in said body of water.

2. The method of claim 1 including providing a support secured below said payload to inside wall of said tube for supporting said payload above said flow blocking device.

3. The method of claim 1 including providing a power supply for both said flow blocking device and said actuation device.

4. The method of claim 1 wherein said flow blocking device comprises a gate valve for controlling flow of water into said hollow launching tube.

5. The method of claim 4 wherein said gate valve is operated to open and close by the step of operating a hydraulic system connected to said gate valve.

6. The method of claim 4 wherein power is connected to said flow blocking device by a cable for actuation thereof.

7. The method of claim 4 wherein remote control lines connect said actuation device to said flow blocking device for providing power thereto for actuation thereof.

8. A device for launching a payload from a body of water into the atmosphere with said body of water having a top surface and a bottom surface deep in said body of water comprising:

a payload;

an air filled, hollow, upright, vertically-extending launching tube means for launching said payload from said body of water into the atmosphere, said hollow launching tube having an inside wall, an outside wall, a tube top and a tube bottom, with said hollow, air filled launching tube containing said payload;

a water inlet to said tube bottom and a tube outlet open at said top;

a remote control means for flow blocking at said water inlet;

an actuation device connected to said flow blocking device wherein the actuation device is configured to send a remote control signal to open said flow blocking device to launch said payload;

said hollow launching tube installed in said body of water with said tube top extending above said top surface into the atmosphere with said tube bottom located deep in said body of water below said top surface;

an anchor connected to said hollow launching tube with said water inlet positioned with said water inlet and said tube bottom positioned proximate to said bottom surface deep in said body of water;

said tube top positioned above said top surface of said body of water, and, whereby said payload is adapted to be launched into the atmosphere from said hollow, air filled, launching tube projected by water pressure force from deep in said body of water.

9. The device of claim 8 including a support secured below said payload to inside wall of said hollow launching tube for supporting said payload above said flow blocking device.

10. The device of claim 8 including a power supply device connected to both said flow blocking device and said actuation device.

11. The device of claim 8 wherein said means for flow blocking is selected from the group comprising a gate valve and an explosive seal/plug.

12. The device of claim 11 wherein said gate valve is connected to a system selected from the group comprising by a hydraulic system and an electric system.

13. The device of claim 8 wherein a power supply means is connected to said flow blocking device by a cable.

14. The device of claim 8 wherein electric lines are connected between said actuation device and said flow blocking device.

15. The method of claim 1, wherein the inner wall of the launching tube are rifled.

16. The device of claim 8, wherein the inner wall of the launching tube are rifled.

17. The method of claim 1, wherein the inlet is selected from the group comprising a neck and a convergent tubular nozzle.

18. The device of claim 8, wherein the inlet is selected from the group comprising a neck and a convergent tubular nozzle.

* * * * *